United States Patent [19]

Long et al.

[11] 4,442,975

[45] Apr. 17, 1984

[54] STRIPING APPARATUS FOR MARKING SURFACES

[76] Inventors: Ralph W. Long, 53 Elm St.; Charles B. Smith, Rte. 2, Box 390; Don E. Baer, 1520 Peterson Dr., all of Wabash, Ind. 46992

[21] Appl. No.: 356,956

[22] Filed: Mar. 11, 1982

[51] Int. Cl.[3] ..... B05B 1/28

[52] U.S. Cl. ..... 239/150; 239/444

[58] Field of Search ..... 239/124, 126, 150, 172, 239/175, 176, 288, 288.3, 444

[56] References Cited

U.S. PATENT DOCUMENTS

| | | | |
|---|---|---|---|
| 1,999,563 | 4/1935 | Glasgow | 239/175 |
| 2,647,793 | 8/1953 | Mosher | 239/150 |
| 2,815,983 | 12/1957 | Hunter | 239/150 |
| 4,260,107 | 4/1981 | Jackson | 239/142 |

*Primary Examiner*—John J. Love
*Assistant Examiner*—Jon M. Rastello
*Attorney, Agent, or Firm*—Jeffers, Irish & Hoffman

[57] ABSTRACT

A striping apparatus for marking athletic fields and other surfaces comprises a wheeled platform adapted to be propelled by a prime mover and having thereon a tank for containing fluid, a nozzle assembly for spraying the marking fluid on a surface, and a pumping assembly for delivering the marking fluid under selectively variable pressures to the nozzle assembly. The nozzle assembly is adjustably positioned angularly and in elevation relative to the surface to be sprayed, and the pumping assembly is remotely controlled by a switch located on the prime mover. To mark designs, logos, numerals, and the like, an auxiliary hand-held, manually operated hose and nozzle are provided to allow the operator to mark the required figure.

12 Claims, 7 Drawing Figures

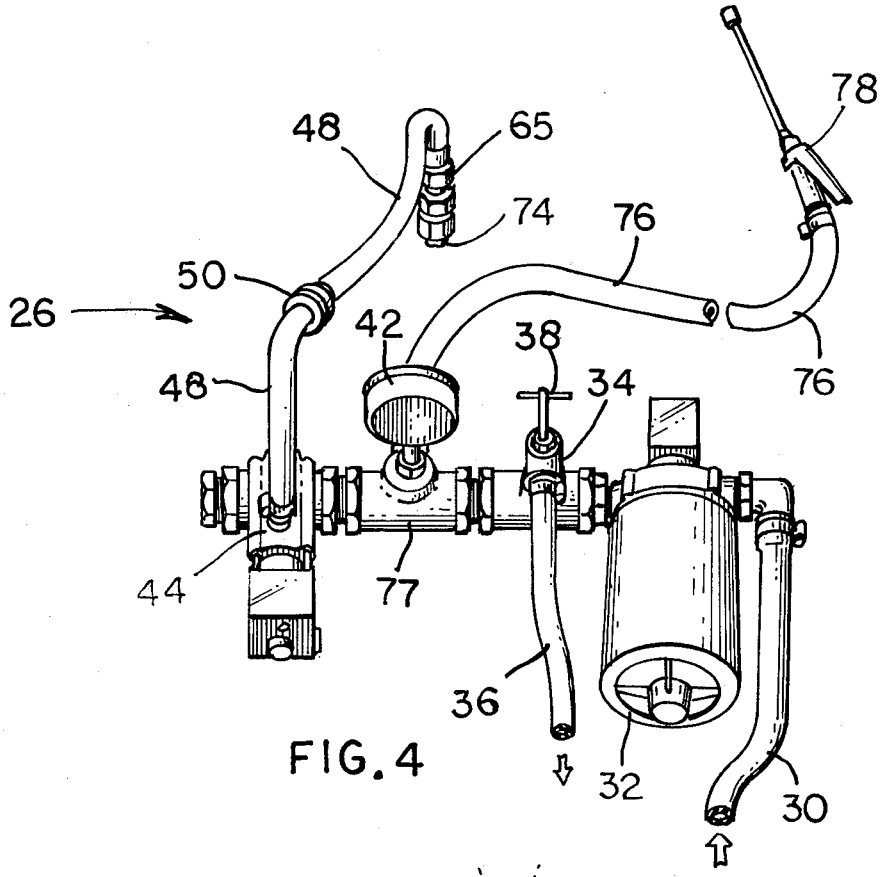
FIG. 4
FIG. 5
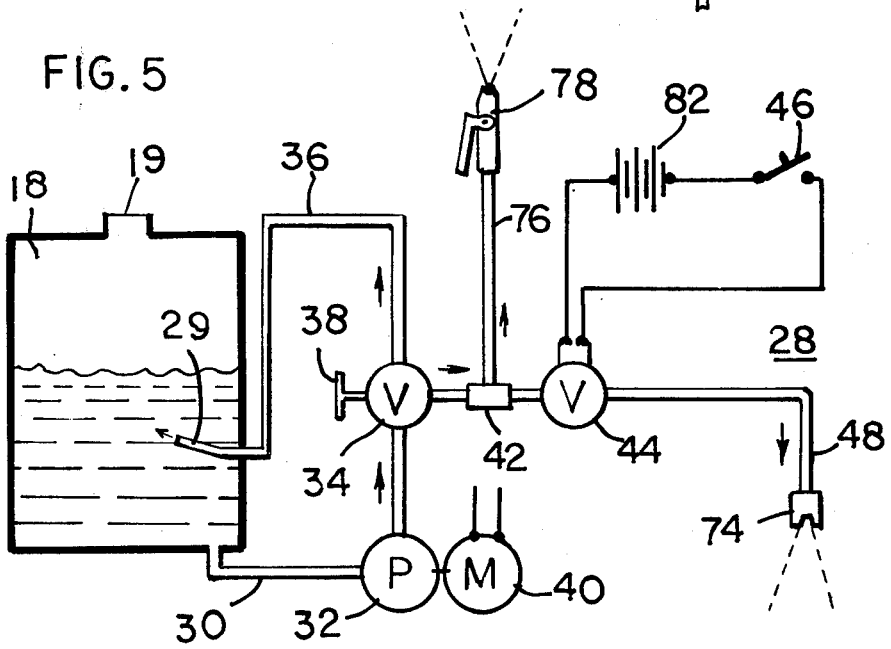

STRIPING APPARATUS FOR MARKING SURFACES

BACKGROUND OF THE INVENTION

Field of the Invention

This invention relates to a striping apparatus, and more particularly to a striping apparatus adapted to mark athletic fields and other surfaces.

Current marking devices for athletic fields are generally carried on a wheeled platform or cart that is manually pushed by the operator back and forth along the surface to be marked, which naturally becomes quite tiresome if the field to be marked is large and even more tiresome if performed in high temperatures. As a result of this, the tank carried on the platform or cart generally has a small volume capacity or is only partially filled with the marking fluid so that it is light enough to allow the operator to manually maneuver the marking device as required. Consequently, the tank may not have the capacity to allow the operator to complete the marking requirements without having to stop and refill the tank with the marking fluid. Additional stops required to refill the tank obviously increases the time to mark the field, and the manner of refilling the tank with the marking fluid is generally messy and therefore undesirable from the operator's point of view. Further, the tank is pressurized by a hand-actuated pump.

Another disadvantage of the current marking devices is that they do not provide a separate hand-held spray nozzle with which the operator may draw designs, logos, numerals and the like, such as a school's emblem or logo and line and yard markers on a football field. With these particular marking devices the operator experiences great difficulty in manually maneuvering the marking device to complete a design, logo, numeral and the like.

SUMMARY OF THE INVENTION

The present invention provides a striping apparatus for marking athletic fields and other surfaces which eliminates the above disadvantages of the current marking devices. The present invention provides a wheeled platform propelled by a prime mover such as a riding lawnmower, garden-size tractor and thus, can carry a tank having a capacity sufficient to complete most marking requirements without having to be refilled. Further, pressure for spraying the marking fluid is provided by a motor-driven pump on the platform.

The nozzle from which the marking fluid is sprayed is housed in a protective housing, which is connected to a part of the platform, for example, the tongue of a trailer, and is adjustable angularly and in elevation relative to the ground by a fastening device connected to the platform that is received through a vertically disposed slot in the protective housing. By loosening the fastening device, the protective housing may be rotated and/or elevated to compensate for different surfaces to be sprayed or different towing vehicles. The protective housing also serves to protect the fluid being sprayed from gusts of wind which would tend to disperse the sprayed fluid. Also provided is an adjustable valve arrangement between the tank and the nozzle for selectively adjusting the pressure of the sprayed fluid.

The present invention also provides an auxiliary hand-held, manually-operated nozzle for marking designs, logos, numerals, and the like, such as a school emblem and line and yard markers for a football field.

To initiate operation of the striping apparatus, the present invention provides a remote control switch which may be mounted on the towing vehicle and energized by the same battery used with the vehicle.

In the broader aspects of this invention, there is provided a striping apparatus for marking athletic fields and other surfaces comprising a mechanically propelled wheeled platform having a tank mounted thereon for containing fluid to be sprayed, a nozzle device connected to the platform and adjustable angularly and in elevation relative to the surface for spraying the fluid thereon, and a pump assembly connected between the tank and the nozzle device for delivering the fluid under a desired pressure to the nozzle device.

It is an object of the present invention to provide an improved striping apparatus for athletic fields and other surfaces which is propelled by a vehicle and, consequently, capable of carrying a tank thereon having a sufficient capacity to allow completion of marking requirements without having to be refilled.

Another object of the present invention is to provide a nozzle device which is adjustable angularly and in elevation relative to the surface to be sprayed, and a valve arrangement between the tank and the nozzle device to deliver the fluid to the nozzle device under pressures adjustable by the operator.

A further object of the present invention is to provide an alternate hand-held, manually operated nozzle that permits the operator to create designs, logos, numerals, and the like on surfaces.

A still further object of the present invention is to provide the operator with remote control means for operating the nozzle device.

BRIEF DESCRIPTION OF THE DRAWINGS

The above-mentioned and other features and objects of this invention, and the manner of attaining them, will become more apparent and the invention itself will be better understood by reference to the following description of an embodiment of the invention taken in conjunction with the accompanying drawings, wherein:

FIG. 4 is a perspective view of the pumping assembly of the invention;

FIG. 5 is a schematic diagram showing the pumping and spraying system of the invention;

DESCRIPTION OF THE PREFERRED EMBODIMENT

Figure 1:
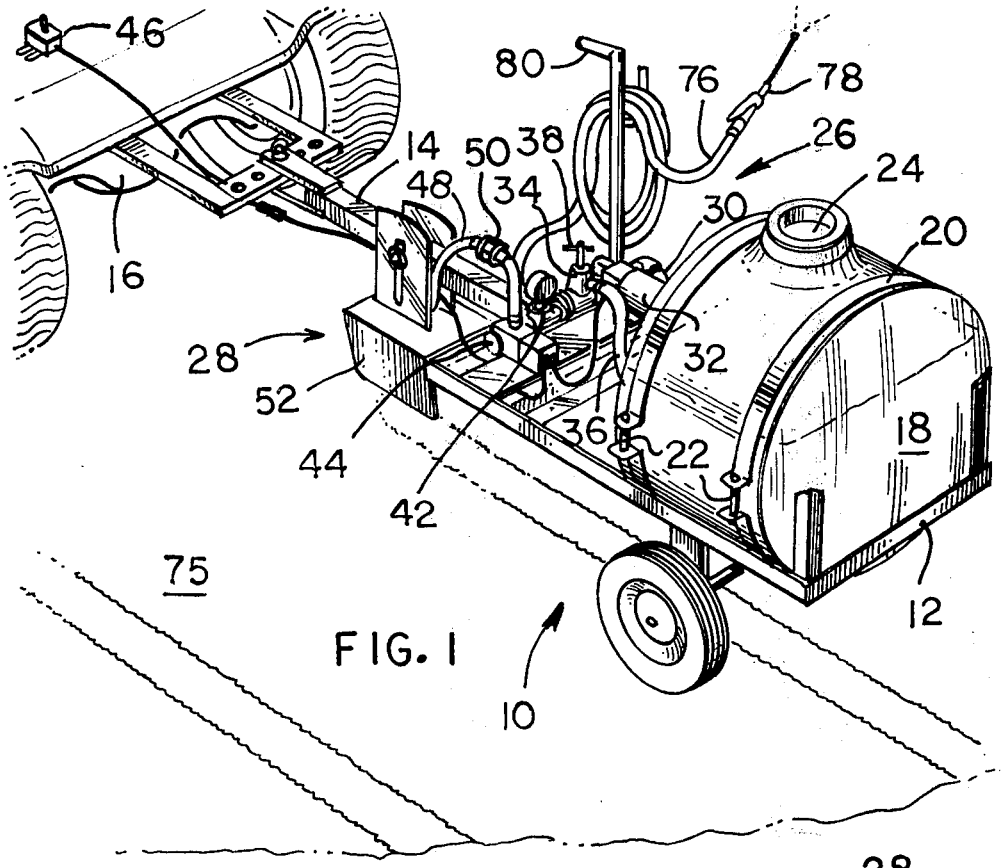
FIG. 1 is a perspective of a preferred embodiment of the present invention.

Referring to the drawings, and particularly FIG. 1, striping apparatus 10 of the present invention comprises trailer 12 having tongue 14 adapted to be connected to tractor 16. Marking fluid tank 18 is secured to trailer 12 by straps 20, which are secured together by fasteners 22 which may of any suitable type, and has cap 24 for closing fill opening 19 (FIG. 5). Fill opening 19 is of sufficient size to allow the operator to clean the interior surfaces of tank 18 after the completion of striping a particular surface or if required when changing fluid types.

Mounted on the forward portion of trailer 12 are pumping assembly 26 and nozzle assembly 28. Pumping assembly 26 (FIGS. 4 and 5) includes flexible outlet hose 30 connected to tank 18 and to the input side of pump 32, which may be a constant volume pump operated by a suitable DC motor 40. Connected to the output side of pump 32 is diverter valve 34 which has flexible return hose 36 connected thereto and to tank 18. By adjusting handle 38 of diverter valve 34, the flow of fluid through diverter valve 34 may be adjusted thereby varying the pressure of the fluid flowing to nozzle assembly 28.

Pressure gauge 42 is connected to the outlet side of diverter valve 34. The outlet side of diverter valve 34 is connected to solenoid valve 44, which is electrically operated by remote control switch 46. Switch 46 may be conveniently located on tractor 16 within reach of the operator. Connected to the outlet side of solenoid valve 44 is flexible hose 48 for delivering the marking fluid to nozzle assembly 28; hose connector 50 is illustrated joining two sections of flexible hose 48 together.

Hoses 30, 36 and 48 have been referred to as flexible, however, flexibility is not necessarily required and the hoses may be replaced by metal piping, plastic tubing, or the like as required to withstand any chemically-reactant substances which may be sprayed by nozzle assembly 28. Also, pump 32, diverter valve 34, DC motor 40, pressure gauge 42, solenoid valve 44, and remote control switch 46 may be connected in any conventional manner.

Figure 7:
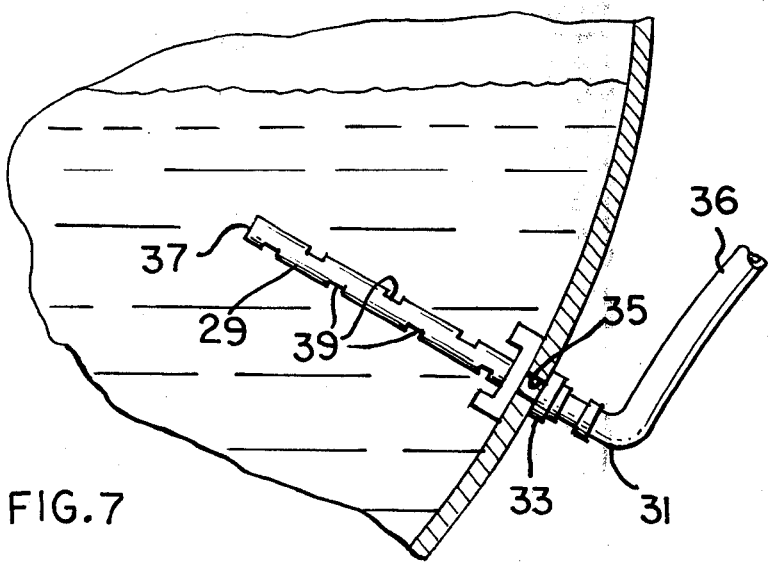
FIG. 7 is a fragmentary, partially broken away view of a container and a mixing tube therein of the preferred embodiment.

Also provided with pumping assembly 26 is mixing tube 29 (FIG. 7) connected to return hose end 31 by coupler 33 disposed in tank hole 35. Tube 29 is disposed in the bottom portion of tank 18 so as to be submerged in the marking fluid, and is upwardly angled to facilitate mixing of the fluid. End opening 37 and a plurality of side openings 39 are disposed in tube 29 to provide the mixing feature thereof. Mixing tube 29 will continually mix the marking fluid in tank 18 if pump 32 is being operated by motor 40, and the mixing will occur whether apparatus 10 is stationary or moving. Maximum mixing in tank 18 occurs when manually-operated nozzle 78 is closed, remote control switch 46 is open, pump 32 is running, and diverter valve 34 is adjusted to divert the marking fluid being pumped through hose 36 and into tank 18 via mixing tube 29. The mixing action may be varied by adjusting handle 38, and, naturally, the mixing action will decrease when nozzle 78 is opened or switch 46 is closed.

Figure 2:
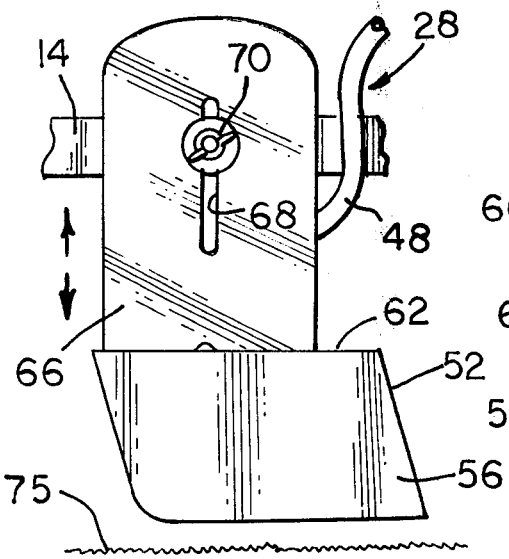
FIG. 2 is a side elevational view of the nozzle assembly of the embodiment of FIG. 1.
Figure 3:
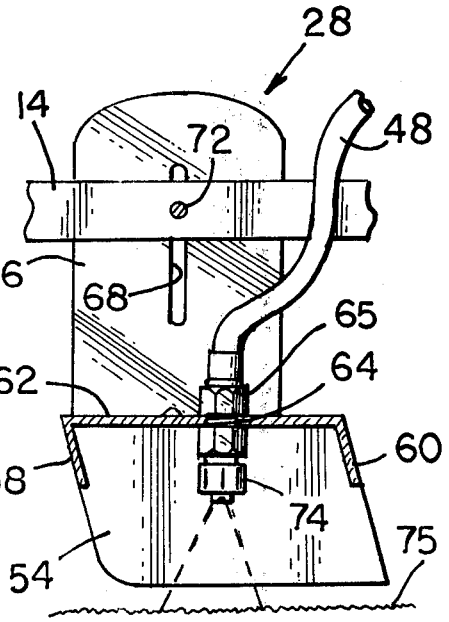
FIG. 3 is a broken-away view of FIG. 2.
Figure 6:
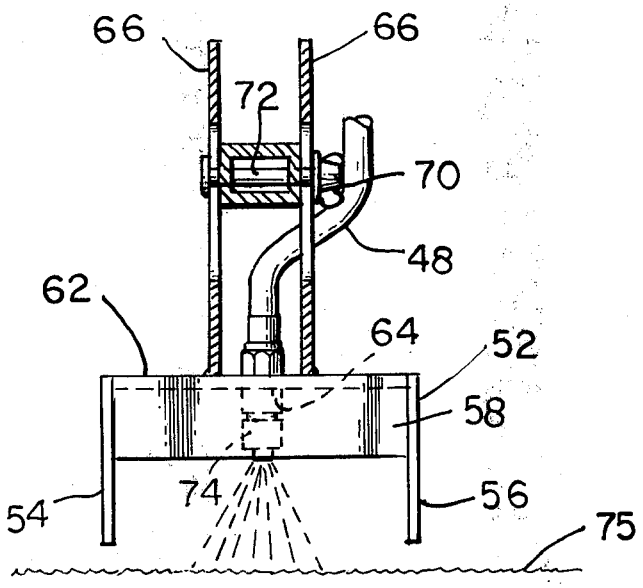
FIG. 6 is a front elevational view of the nozzle assembly of the invention.

Referring now to FIGS. 2, 3 and 6, nozzle assembly 28 comprises housing 52 having side walls 54, 56, front wall 58, back wall 60 and top wall 62 with hole 64 therein. Upstanding from top wall 62 are two flanges 66, each having a vertically disposed slot 68 therein and which are connected to tongue 14 by a fastener, such as stud 70 received through tongue hole 72 and slots 68. Flanges 66 are preferably parallel to one another and spaced apart a distance slightly greater than the width of tongue 14; if flanges 66 are spaced a greater distance apart than the width of tongue 14, a spacer block (not shown) may be received between one of the flanges 66 and tongue 14. Nozzle 74 is received through and secured in hole 64 by suitable connector 65, and is connected to the outlet end of flexible hose 48 to receive fluid therefrom.

To provide a means for marking designs, logos, numerals and the like on surfaces, flexible auxiliary hose 76 is connected to intermediate pipe 77, to which pressure gauge 42 is connected, and has manually operated nozzle 78 connected to its outlet end. Auxiliary hose support 80 is attached to trailer 12 for carrying auxiliary hose 76 and nozzle 78 thereon when not in use.

In operation, the operator will determine from the markings required and the size of surface 75 to be marked the amount of fluid to be received within tank 18, which in the illustrated embodiment has a capacity of 25 gallons. Tongue 14 is connected to tractor 16, and depending upon the type of surface 75 to be sprayed, nozzle 74 is adjusted accordingly by loosening a wing nut on stud 70 and rotating and/or sliding flanges 66 on stud 70 in order to properly orient nozzle 74 with respect to surface 75. Thereafter, motor 40 is energized to drive pump 32, and handle 38 of diverter valve 34 is adjusted to the appropriate fluid pressure as indicated on pressure gauge 42. The operator initiates spraying by opening solenoid 44 via remote control switch 46, which is connected to tractor battery 82 (FIG. 5). Because nozzle 74 is essentially centered with respect to tractor 16 on tongue 14, and assuming the operator is likewise essentially centered with respect to tractor 16, marking a straight line is an easy accomplishment.

When specific designs, logos, numerals, and the like are required to be marked, the operator may close solenoid valve 44 with remote control switch 46 and then use auxiliary hose 76 and manually operated nozzle 78 to form the desired figure.

Applicants have found that lining track fields, parking lots, and other hard surfaces is easily accomplished using striping apparatus 10 with a fluid pressure of approximately 30 psi and with the bottom edges of sidewalls 54, 56 of housing 52 adjusted to be just slightly above a hard surface. For grass and similar surfaces, such as football fields and soccer fields, a pressure of 30 psi and a nozzle elevation attained by positioning the bottom edges of sidewalls 54, 56 approximately 3 inches above the surface serves to spray the marking fluid on and through the grass to the ground surface. Pressures substantially lower than those recommended have been found to provide only light markings on hard surfaces and only surface coverage on grass and similar surfaces, while pressures substantially higher than those recommended have been found to cause splashing of the fluid on hard surfaces and excessive waste of fluid on grass and similar surfaces.

Obviously, the above pressures and housing elevations will vary depending on the type and size of nozzle 74 utilized with striping apparatus 10, and consequently, an area away from the surface to be marked should be utilized to adjust the pressure and nozzle height to obtain the desired results for the marking required.

While this invention has been described as having a specific embodiment, it will be understood that it is capable of further modifications. This application is therefore intended to cover any variations, uses, or adaptations of the invention following the general principles thereof, and including such departures from the Present disclosure as come within known or customary practice in the art to which this invention pertains and fall within the limits of the appended claims.

What is claimed is:

1. In combination with a wheeled platform having a container mounted thereon for containing a marking fluid and adapted to be propelled by a prime mover over a surface, and means on said platform for delivering under pressure the fluid in said container, a marking apparatus for marking surfaces with the fluid, comprising:

two generally vertically disposed parallel support members embracing a portion of said platform and having aligned elongated slots generally vertically disposed therein, a generally horizontally disposed plate member having a hole therein and secured to said support members with said hole between said support members, a continuous wall extending downwardly from the periphery of said plate member, said continuous wall having opposite side walls substantially parallel to said support members and extending downwardly a first length from said plate member, and front and back walls joining said side walls and extending downwardly from said plate member a second length less than said first length, a bolt received through a hole in said platform portion and through said slots, and a fastener threadedly received on one end of said bolt for adjustably securing said support members to said platform portion, and a nozzle means connected to said delivering means and received through and secured in said hole in said plate member, said nozzle means being adjustably positioned angularly and in elevation relative to the surface to be sprayed by adjustment of said support members.

2. The apparatus of claim 1 further including hand-held auxiliary means connected to said delivering means for manually spraying the fluid on surfaces to be marked.

3. A striping apparatus for marking athletic fields and other surfaces, comprising:

a propellable platform having a container thereon for containing marking fluid, means on said platform for spraying the fluid on a surface to be marked, means on said platform for delivering the fluid under selective pressures from said container to said spraying means, said spraying means including two generally vertically disposed parallel support means embracing a portion of said platform and respectively having aligned elongate slots generally vertically disposed therein, a generally horizontally disposed plate member having a hole therein and secured to said support members with said hole between said support members, a continuous wall extending downwardly from the periphery of said plate member, said continuous wall having opposite side walls substantially parallel to said support members and extending downwardly a first length from said plate member, and front and back walls joining said side walls and extending downwardly from said plate member a second length less than said first length, means received through a hole in said portion of said platform and through said slots for adjustably securing said support members to said portion, nozzle means connected to said delivering means and received through and secured in said hole in said plate member and between said support members, said nozzle means being adjustably positioned angularly and in elevation relative to the surface to be sprayed by adjustment of said support members, and a hollow tube member having opposite ends and being disposed in said container, one of said ends being connected to said delivering means, said delivering means including adjustable means for returning marking fluid to said hollow tube member and into said container.

4. The apparatus of claim 3 wherein the other end of said hollow tube member is angularly disposed upwardly from said one end, and said tube member has a plurality of openings disposed therein to provide mixing of the fluid in said container when fluid is pumped through said tube member other end and openings by said delivering means.

5. The apparatus of claim 4 wherein said delivering means is selectively variable in pressure and includes power-driven means for pumping the fluid from said container to said nozzle means.

6. The apparatus of claim 5 further including hand-held auxiliary means connected to said delivering means for manually spraying the marking fluid on a surface to be marked.

7. The apparatus of claim 6 further including remote controlled means for actuating said power-driven pumping means.

8. A striping apparatus for marking athletic fields and other surfaces, comprising:

a trailer including a tongue for towing and a container for containing marking fluid, means on said trailer for spraying the fluid on a surface to be marked, means on said trailer for delivering the fluid under selective pressures from said container to said spraying means, said spraying means including two generally vertically disposed parallel support members embracing said tongue and having aligned elongated slots generally vertically disposed therein, a generally horizontally disposed plate member having a hole therein and secured to said support members with said hole between said support members, a continuous wall extending downwardly from the periphery of said plate member, said continuous wall having opposite side walls substantially parallel to said support members and extending downwardly a first length from said plate member and front and back walls joining said side walls and extending downwardly from said plate member a second length less than said first length, a bolt received through a hole in said tongue and through said slots, and a fastener threadedly received on one end of said bolt for adjustably securing said support members to said tongue, nozzle means connected to said delivering means and received through and secured in said hole in said plate member and between said support members, said nozzle means being adjustably positioned angularly and in elevation relative to the surface to be sprayed by adjustment of said support members, and a hollow tube member having opposed open ends and being disposed in said container, one of said ends being connected to said delivering means, said delivering means being adjustable to direct marking fluid to said hollow tube member and into said container.

9. The apparatus of claim 8 wherein the opposite open end of said hollow tube member is angularly disposed upwardly from said one open end, and said tube member has a plurality of openings disposed therein to provide mixing of the fluid in said container when fluid is pumped through said tube member opposite open end and openings by said delivering means.

10. The apparatus of claim 9 wherein said delivering means is selectively variable in pressure and includes power-driven means for pumping the fluid from said container to said nozzle means.

11. The apparatus of claim 10 further including hand-held auxiliary means connected to said delivering means for manually spraying the marking fluid on a surface to be marked.

12. The apparatus of claim 11 further including remote controlled means for actuating said power-driven pumping means.

* * * * *

UNITED STATES PATENT AND TRADEMARK OFFICE

CERTIFICATE OF CORRECTION

PATENT NO. : 4,442,975

DATED : April 17, 1984

INVENTOR(S) : Ralph W. Long, Charles B. Smith, Don E. Baer

It is certified that error appears in the above—identified patent and that said Letters Patent is hereby corrected as shown below:

Col. 4, line 63 change "Present" to --present--.

Signed and Sealed this

*Sixteenth* Day of *October 1984*

[SEAL]

*Attest:*

GERALD J. MOSSINGHOFF

*Attesting Officer*

*Commissioner of Patents and Trademarks*